United States Patent [19]

Kaneshige et al.

[11] Patent Number: 4,877,557

[45] Date of Patent: Oct. 31, 1989

[54] LUBRICATING OIL COMPOSITION

[75] Inventors: Ryousuke Kaneshige; Kinya Mizui, both of Ichihara, Japan

[73] Assignee: Mitsui Petrochemical Industries, Ltd., Tokyo, Japan

[21] Appl. No.: 155,076

[22] Filed: Feb. 11, 1988

[30] Foreign Application Priority Data

Feb. 12, 1987 [JP] Japan ..... 62-28067

[51] Int. Cl.[4] ..... C10M 161/00

[52] U.S. Cl. ..... 252/56 S; 252/32.7 E; 252/47.5; 252/49.8; 252/56 D; 252/58

[58] Field of Search ..... 252/56 D, 56 S, 32.7 E, 252/47.5, 49.8, 58

[56] References Cited

U.S. PATENT DOCUMENTS

| | | | |
|---|---|---|---|
| 3,269,946 | 8/1966 | Wiese | 252/32.5 |
| 3,271,310 | 9/1966 | LeSuer | 252/56 D |
| 3,282,971 | 11/1966 | Metro et al. | 252/56 S |
| 3,381,022 | 4/1968 | LeSuer | 252/56 D |
| 4,069,162 | 1/1978 | Gardiner et al. | 252/32.5 |
| 4,089,794 | 5/1978 | Engel et al. | 252/56 D |
| 4,161,452 | 7/1979 | Stambaugh et al. | 252/56 D |
| 4,546,137 | 10/1985 | Rossi et al. | 252/56 S |
| 4,557,847 | 12/1985 | Gutierrez et al. | 252/56 D |
| 4,632,769 | 12/1986 | Gutierrez et al. | 252/56 D |
| 4,693,838 | 9/1987 | Varma et al. | 252/56 D |
| 4,735,736 | 4/1988 | Chung | 252/56 D |

FOREIGN PATENT DOCUMENTS 0183493 6/1986 European Pat. Off. .

OTHER PUBLICATIONS

C. V. Smalheer and R. Kennedy Smith, Lubricant Additives, 1967, pp. 1-11.

*Primary Examiner*—William R. Dixon, Jr.
*Assistant Examiner*—Jerry D. Johnson
*Attorney, Agent, or Firm*—Sherman and Shalloway

[57] ABSTRACT

Disclosed is a lubricating oil composition comprising, as indispensable components, (A) a synthetic hydrocarbon lubricating oil, (B) a load-withstanding additive and (C) a liquid modified ethylene/α-olefin random copolymer. In this lubricating oil composition, the load-withstanding oil is homogeneously and stably incorporated. This lubricating oil is significant in that the poor compatibity with a load-withstanding additive, which is the defect of synthetic hydrocarbon lubricating oils, is effectively overcome.

20 Claims, No Drawings

LUBRICATING OIL COMPOSITION

BACKGROUND OF THE INVENTION (1) Field of the Invention

The present invention relates to a lubricating oil composition comprising a synthetic hydrocarbon lubricating oil as the base oil. More particularly, the present invention relates to a lubricating oil composition excellent in the compatibility with a load-withstanding additive.

(2) Description of the Prior Art

A refined petroleum type lubricating oil and a synthetic hydrocarbon type lubricating oil are known as typical examples of the lubricating oil.

The former refined petroleum type lubricating oil is easily oxidized and deteriorated because it contains structurally unstable double bonds. Furthermore, since the molecular weight is generally low (less than 500), the evaporation loss is large and the abrasion resistance is insufficient.

In contrast, the latter synthetic hydrocarbon type lubricating oil is structurally more stable than the former type lubricating oil, and the molecular weight can be adjusted within a broad range. Especially, if a specific monomer is selected and polymerized, it is possible to give such characteristics as a low pour point and a high viscosity index to the lubricating oil.

However, this synthetic hydrocarbon type lubricating oil is poor in the compatibility with a load-withstanding additive generally incorporated into a lubricating oil, and therefore, the use of this lubricating oil is restricted.

SUMMARY OF THE INVENTION

It is therefore a primary object of the present invention to provide a lubricating oil composition comprising a synthetic hydrocarbon lubricating oil as the base and having an excellent compatibility with a load-withstanding additive.

More specifically, in accordance with the present invention, there is provided a lubricating oil composition comprising, as indispensable component, (A) 100 parts by weight of a synthetic hydrocarbon lubricating oil, (B) 0.1 to 20 parts by weight of a load-withstanding additive and (C) 0.8 to 200 parts by weight of a liquid modified ethylene/α-olefin random copolymer, which is formed by graft-bonding an unsaturated carboxylic acid or a derivative thereof to an ethylene/α-olefin random copolymer, in which (i) the ethylene content in the unmodified ethylene/α-olefin random copolymer is 30 to 75 mole %, (ii) the grafting ratio of the unsaturated carboxylic acid or the derivative thereof is 0.2 to 50 parts by weight per 100 parts by weight of the unmodified ethylene/α-olefin random copolymer and (iii) the intrinsic viscosity [η] as measured in decalin at 135° C. is in the range of from 0.01 to 0.3 dl/g and the molecular weight distribution ($\overline{Mw}/\overline{Mn}$) determined by the gel permeation chromatography is not larger than 4.

The lubricating oil composition of the present invention is characterized in that a predetermined amount of a liquid modified ethylene/α-olefin random copolymer [component (C)] is incorporated in addition to a synthetic hydrocarbon lubricating oil [component (A)] and a load-withstanding additive [component (B)].

As pointed out hereinbefore, the synthetic hydrocarbon lubricating oil as the component (A) has excellent characteristics as the lubricating oil but the compatibility with a load-withstanding additive is poor and the use is therefore remarkably restricted.

In contrast, according to the present invention, by incorporating a predetermined amount of the liquid modified ethylene/α-olefin random copolymer, the compatibility of the synthetic hydrocarbon lubricating oil with the load-withstanding additive is improved and the respective components can be homogeneously incorporated.

Furthermore, since the liquid modified ethylene/α-olefin random copolymer used in the present invention has a lubricating effect by itself, and this modified random copolymer improves the lubricating effect without degrading the characteristics of the unmodified ethylene/α-olefin random copolymer that can be a synthetic hydrocarbon lubricating oil as the base oil.

DETAILED DESCRIPTION OF THE PREFERRED EMBODIMENTS

The present invention will now be described in detail.

Synthetic Hydrocarbon Lubricating Oil (A)

Known lubricating oils are used as the base oil in the present invention. For example, there can be used as a poly(α-olefin) oil such as polydecene-1, an alkyl aromatic oil such as an alkylbenzene, a polybutene oil, an alkylnaphthene oil such as 2,4-dicyclohexyl-2-methylpentane oil, and an ethylene/α-olefin random copolymer oil such as an ethylene/propylene random copolymer oil.

As the poly-α-olefin oil (for example, low-moleculr-weight oligomer of an α-olefin), there can be utilized, for example, low-molecular-weight oligomers of α-olefins having 3 to 20, especialy 8 (octene) to 12 (dodecene) carbon atoms and mixtures of these α-olefins. Low-viscosity α-olefin oligomers can be produced by Ziegler catalysis, thermal polymerization and free radically catalyzed polymerization, preferably, $BF_3$ catalyzed polymerization. A number of similar processes using $BF_3$ in conjunction with a cocatalyst are known and disclosed in literature references. A typical polymerization technique is taught in the specification of U.S. Pat. No. 4,045,508.

Alkylbenzenes can be used in the present invention alone or in conjunction with low-viscosity poly-α-olefins in blends with high-viscosity synthetic hydrocarbons and low-viscosity esters. The alkylbenzenes prepared by Friedel-Crafts alkylation of benzene with an olefin are usually predominantly dialkylbenzenes where the alkyl chain has 6 to 14 carbon atoms. The alkylating olefins used in the preparation of alkylbenzenes can be linear or branched olefins or mixtures thereof. These materials can be prepared according to the process disclosed in the specification of U.S. Pat. No. 3,909,432.

Of these lubricating oils, a poly-α-olefin oil, especially a poly-α-olefin oil having a viscosity of 1 to 20 cst, and an unmodified ethylene/α-olefin random copolymer used as the base of the liquid modified ethylene/α-olefin random copolymer as the component (C) described hereinafter are especially preferably used.

Load-Withstanding Additive (B)

The load-withstanding additive imparts a load-carrying capacity to a base oil at the boundary lubrication and extreme pressure lubrication when the load-withstanding additive is incorporated into the base oil. The load-withstanding additive is roughly divided into an oilness agent and an extreme pressure agent.

The oilness agent is a compound capable of reducing the friction coefficient by physical or chemical adsorption on the friction surface. As the oilness agent, there can be mentioned higher fatty acids such as oleic acid and stearic acid, higher alcohols such as oleyl alcohol, stearyl alcohol and palmityl alcohol, and higher amines such as oleylamine, stearylamine and palmitylamine. The extreme pressure agent is a compound capable of preventing wear or seizure by direct reaction with the metal surface under local high-temperature and high-pressure conditions while forming an extreme pressure coating or forming a coating of a thermal decomposition product of the additive on the friction surface.

All of known extreme pressure agents can be used in the present invention. For example, there can be mentioned sulfur type extreme pressure agents such as dibutyldithiocarbamic acid sulfide and dibenzyl sulfide, phosphorus type extreme pressure agents such as dibutyl phosphate and diphenyl phosphate, halogen type extreme pressure agents such as oleyl chloride and chlorinated paraffin, and organic metal type extreme pressure agents such as zinc dithiophosphate, molybdenum dithiophosphate and lead naphthenate. In general, sulfur type extreme pressure agents are excellent in the seizure resistance, and phosphorus type extreme pressure agents are excellent in the wear resistance. It is preferred that a sulfur type extreme pressure agent and a phosphorus type extreme pressure agent be used in combination.

The above-mentioned load-withstanding additives can be appropriately used singly or in the form of a mixture of two or more of them according to the intended use of the lubricant.

Liquid Modified Random Copolymer (C)

In the present invention, a liquid modified ethylene/α-olefin random copolymer is used in addition to the above-mentioned components (A) and (B).

The liquid modified random copolymer is a copolymer obtained by graft-modifying a liquid ethylene/α-olefin random copolymer formed from ethylene and an α-olefin having 3 to 20 carbon atoms (often called "unmodified copolymer" hereinafter).

As the α-olefin, there can be used α-olefins having 3 to 20 carbon atoms, such as propylene, 1-butene, 1-hexene, 4-methyl-1-pentene, 3-methyl-1-pentene, 1-octene, 1-decene, 1-dodecene, 1-tetradecene, 1-hexadecene, 1-octadecene and 1-eicosane.

In the unmodified copolymer used for the preparation of the modified random copolymer in order to obtain effect of the present invention, that is the effect of improving the compatibility, it is preferred that the ethylene content (a) should be 30 to 75 mole %, especially 40 to 70 mole %, and the α-olefin content (b) should be 25 to 70 mole %, especially 30 to 60 mole % (the total amount of ethylene and the α-olefin is 100 mole %).

As the unmodified liquid copolymer, there is used an unmodified copolymer having an intrinsic viscosity of 0.01 to 0.3 dl/g, preferably 0.03 to 0.25 dl/g, as measured in decalin at 135° C., a number average molecular weight ($\overline{Mn}$) of 300 to 12000, preferably 500 to 8000, especially preferably 500 to 4,000 and a molecular weight distribution ($\overline{Mw}/\overline{Mn}$) of 1.1 to 4, preferably 1.2 to 3, as measured by the GPC method.

An unmodified liquid copolymer having a Z value of 10 to 300, especially 15 to 250, and a σ value of 0 to 3, especially 0 to 2, is preferably used.

Incidentally, the ethylene content/propylene content ratio in the ethylene/α-olefin random copolymer is determined according to the infrared absorption spectrum method, and the intrinsic viscosity, molecular weight distribution, number average molecular weight, Z value and σ value are determined according to the following methods.

(1) Intrinsic Viscosity (η) (dl/g)

The intrinsic viscosity is measured in decalin at 135° C.

(2) Molecular Weight Distribution

The molecular weight distribution is defined as the ratio of the weight average molecular weight ($\overline{Mw}$) to the number average molecular weight ($\overline{Mn}$) and is measured by the gel permeation chromatography (GPC) method.

(3) The number average molecular is measured by the GPC method.

(4) Z value

The Z value is the ratio of the maximum value of the molecular weight to the minimum value of the molecular weight determined in accordance with the GPC method described in detail hereinafter.

(5) σ Value

The σ value is calculated in accordance with the following formula:

$$E = \sum_i EiWi / \sum_i Wi$$

$$\sigma = \sqrt{\sum_i (Ei - E)^2 Wi}$$

by fractionating the copolymer with acetone/hexane mixed solvents differing in the mixing proportion, and finding the ethylene content (Ei) and the weight ratio (Wi) based on the total weight of the copolymer, of the copolymer extracted in the i-th fraction. The σ value is a measure indicating the composition distribution of the copolymer.

More specific methods of determining the molecular weight distribution, the number average molecular weight and the Z value are described below.

The number average molecular weight and weight average molecular weight of the copolymer are measured by the following method, which is described in detail in Journal of Polymer Science, Part A-II, vol. 8, pages 89–103 (1970).

Elution counts of a standard substance having a known molecular weight (16 samples of monodisperse polystyrene having differnet molecular weights selected from the range of 500 to $840 \times 10^4$) are measured by GPC (gel permeation chromatography), and a calibration curve showing the relation between the molecular weight and the elution count is prepared. The GPC pattern of a copolymer sample is taken by GPC. From the calibration curve, the molecular weights (Mi) at the individual counts (i) are read, and from the GPC pattern, the elution volumes (Ni) at the individual counts (i) are read. The number average molecular weight ($\overline{Mn}$) and weight average molecular weight ($\overline{Mw}$), both as polystyrene, of the copolymer sample are calculated in accordance with the following equations:

$$Mn = \Sigma MiNi / \Sigma Ni, \text{ and}$$

-continued $$Mw = \Sigma Mi^2Ni/\Sigma MiNi$$

Separately, the molecular weight, calculated as polystyrene, of aqualane (an isoparaffinic standard substance having a molecular weight of 422) is measured by GPC.

Thus, the $\overline{Mn}$, Q value and Z value of the copolymer of the present invention are calculated by the following equations:

$$Mn \text{ of the copolymer} = \frac{Mn \text{ of copolymer as polystyrene}}{\text{Molecular weight of squalane as polystyrene}} \times \text{molecular weight of squalane (422)}$$

$$Q \text{ value} = \frac{Mw \text{ of copolymer as polystyrene}}{Mn \text{ of copolymer as polystyrene}}$$

The minimum and maximum elution counts of the GPC pattern of the copolymer are read, and the corresponding minimum and maximum molecular weights of the copolymer, calculated as polystyrene, are read from the calibration curve. The Z curve is calculated from the following equation:

$$Z \text{ value} = \frac{\text{Maximum molecular weight of the copolymer as polystyrene}}{\text{Minimum molecular weight of the copolymer as polystyrene}}$$

Specific examples of the α-olefin having 3 to 20 carbon atoms, to be copolymerized with ethylene in the preparation of the ethylenic random copolymer as a base polymer, include propylene, 1-butene, 1-hexene, 4-methyl-1-pentene, 3-methyl-1-pentene, 1-octone, 1-docene, 1-dodecene, 1-tetradecene, 1-hexadecene, 1-octadecene and 1-eicosene, α-olefin having 3 to 10 carbon atoms, such as propylene, 1-butene, 1-hexene, 1-octene and 1-decene, particularly propylene and 1-butene, are preferred. They may be used either singly or in combination.

The copolymerization of ethylene with the α-olefin can be carried out by using ziegler catalysts known per se, preferably by the methods disclosed in Japanese Patent Application Laid-Open Specification Nos. 117595/82 and 123205/82 and European Patent Application No. 60609 (A.1). For example, Japanese Patent Application Laid-Open Specification No. 123205/82 discloses a method for copolymerizing ethylene with an α-olefin having at least 3 carbon atoms in the liquid phase in the presence of hydrogen by using a catalyst formed from a soluble vanadium compound and an organoaluminum compound. In this method, the copolymerization is carried out continuously. The concentration of the vanadium compound in the polymerization system is adjusted to at least 0.3 millimole per liter of the liquid phase, and the vanadium compound to be fed to the polymerization system is used as diluted in a polymerization medium so that its concentration is not more than 5 times the concentration of the vanadium compound in the polymerization system.

The ethylene random copolymer used as a base in the present invention is preferably liquid at normal temperature.

The liquid modified random copolymer used in the present invention is obtained by graft-modifying the above-mentioned unmodified copolymer with an unsaturated carboxylic acid or a derivative thereof.

An unsaturated carboxylic acid having 3 to 20 carbon atoms, preferably 3 to 10 carbon atoms, or a derivative thereof is used as the unsaturated carboxylic acid or its derivative as the grafting comonomer component. For example, there can be mentioned unsaturated carboxylic acids such as acrylic acid, methacrylic acid, maleic acid, fumaric acid, itaconic acid, citraconic acid, tetrahydrophthalic acid and bicyclo[2,2,1]hept-2-ene-5,6-dicarboxylic acid, unsaturated carboxylic acid anhydrides such as maleic anhydride, itaconic anhydride, citraconic anhydride, tetrahydrophthalic anhydride and bicyclo[2,2,1]-hept-2-ene-5,6-dicarboxylic acid anhydride, and esters of unsaturated carboxylic acids such as methyl acrylate, methyl methacrylate, dimethyl maleate, monomethyl maleate, diethyl fumarate, dimethyl itaconate, diethyl citraconate, dimethyl tetrahydrophthalate and dimethyl bicyclo[2,2,1]-hept-2-ene-5,6-dicarboxylate.

Of these compounds, maleic anhydride is especially preferred.

In the present invention, in order to improve the compatibility, it is preferred that the grafting ratio of the unsaturated carboxylic acid or its derivative should be 0.2 to 50 parts by weight, especially 0.5 to 40 parts by weight, per 100 parts by weight of the unmodified ethylene α-olefin copolymer.

In the present invention, in order to improve the compatibility of the component (B) with the load-withstanding additive, it is preferred that the intrinsic viscosity [η] of the liquid modified ethylene type random copolymer should be 0.01 to 0.3 dl/g, especially 0.03 to 0.25 dl/g, as measured in decalin at 135° C., and the molecular weight distribution ($\overline{Mw}/\overline{Mn}$) is not larger than 4, especially from 1.2 to 3, as measured by the gel permeation chromatography (GPC).

In the present invention, the number average molecular weight of the above-mentioned liquid modified ethylene type copolymer is ordinarily 310 to 8000 and preferably 500 to 4000.

Incidentally, the liquid modified random copolymer can be prepared from the unmodified copolymer according to the process previously proposed by us in Japanese Patent Application Laid-Open Specification No. 123205/82 and European Patent Laid-Open No. 183493.

The liquid modified random copolymer of this invention can be produced by reacting (graft copolymerizing) the ethylenic random copolymer with the modifier in the presence of a radical initiator. The reaction can be carried out usually in an inert gas atmosphere in the presence of a solvent, or in the absence of a solvent. The reaction can be carried out, for example, by continuously or intermittently feeding the modifier compound and the radical initiator with stirring to the heated liquid ethylenic random copolymer in the presence or absence of a solvent. The proportions of the modifier and the radical initiator fed in this graft copolymerization reaction, and the reaction temperature and time can be varied depending upon the type of the modifier, etc. Generally, these reaction conditions may be selected as tabulated below according to the type of the modifier compound.

Usually organic peroxides are used as the radical initiator for the graft copolymerization reaction. The organic peroxides preferably have a decomposition temperature, at which the half value is 1 minute, of 60° to 270° C., especially 150° to 270° C. Specific examples are organic peroxides and organic peresters, such as benzoyl peroxide, dichlorobenzoyl peroxide, dicumyl peroxide, di-tert-butyl peroxide, 2,5-dimethyl-2,5-di(-peroxybenzoate)hexyne-3, 1,4-bis(tert-butylperoxyisopropyl)benzene, lauroyl peroxide, tert-butyl peracetate, 2,5-dimethyl-2,5-di(tert-butylperoxy)hexyne-3, 2,5-dimethyl-2,5-di(tert-butylperoxy)hexane, tert-butyl perbezoate, tert-butyl perphenylacetate, tert-butyl perisobutyrate, tert-butyl per-sec-octoate, tert-butyl perpivalate, cumyl perpivalate and tert-butyl perdiethylacetate.

Examples of the solvent that can be used are aromatic hydrocarbons such as benzene, toluene, xylene, monochlorobenzene and dichlorobenzene, and aliphatic or alicyclic hydrocarbons or halogenation products thereof, such as pentane, hexane, cyclohexane, heptane, and octane. The aromatic hydrocarbon solvent is preferred. The absence of solvent is also preferred.

The separation of the modified ethylenic random copolymer from the reaction mixture and its purification may be carried out by methods known per se, for example by distillation or solvent fractionation.

Preparation of Lubricating Oil Composition

The lubricating oil composition of the present invention can be easily prepared by incorporating (B) 0.1 to 20 parts by weight, especially 1 to 15 parts by weight, of a load-withstanding additive and (C) 0.8 to 200 parts by weight, especially 1 to 150 parts by weight, of a liquid modified ethylene/α-olefin random copolymer into (A) 100 parts by weight of a synthetic hydrocarbon lubricating oil. The incorporation may be carried out at ordinary temperature (25° C.) or under heating. However, there is preferably adopted a method in which the components (B) and (C) are mixed in advance under heating (50° to 250° C.) and the lubricating oil (A) as the base oil is added to the mixture.

In order to obtain a good compatibility, it is preferred that the load-withstanding additive (B) and the liquid modified ethylene/α-olefin random copolymer (C) be mixed at a mixing (C)/(B) weight ratio of from 0.05 to 200, especially from 1 to 150.

In the lubricating oil composition of the present invention, in addition to the foregoing three components (A) through (C), there may be incorporated a refined petroleum lubricating oil or a synthetic lubricating oil such as a polyether oil, an ester oil or silicon oil in an amount of up to 100% by weight based on the synthetic hydrocarbon lubricating oil as the component (A).

Furthermore, known additives, for example, viscosity index improvers such as polymethacrylic acid esters, polyisobutylene, styrene/isoprene/styrene block copolymers and styrene/butadiene/styrene block copolymers, pour point depressants such as chlorinated paraffin/naphthalene condensates and polyalkyl methacrylates, rust-preventive agents such as dodecylamine and dodecyl ammonium stearate, detergent dispersants such as metal salts of alkyl aromatic sulfonic acids and succinimide, defoaming agents such as dimethyl polysiloxane, colorants such as oil-soluble dyes and anti-oxidants such as phenolic compounds and amine compounds may be added. The amounts incorporated of these additives differ according to the kinds of the additives, but in general, the additives are incorporated in amounts of 0.1 to 10% by weight based on the synthetic hydrocarbon lubricating oil.

The lubricating oil composition of the present invention is excellent in the liquid stability, and even if various load-withstanding additives are incorporated, precipitates are not formed at all and the compatibility is very good. This quality is very important and valuable as is seen from the fact that JIS K-2215 concerning the quality of a lubricating oil for an internal combustion engine stipulates that water or precipitates should not be contained.

Furthermore, since various load-withstanding additives can be optionally incorporated with a good compatibility, it is possible to impart a very high load-carrying capacity according to the intended use.

As is apparent from the examples given hereinafter, the lubricating oil composition of the present invention can be used within a very broad temperature range of from −50° C. to 250° C., and the oxidation stability and shear stability are very high and these characteristics are durable for a long time, with the result that the oil exchange period can be prolonged.

The present invention will now be described in detail with reference to the following examples that by no means limit the scope of the invention.

At first, the preparation of the liquid modified ethylene/α-olefin random copolymer will be described in the following referential examples.

REFERENTIAL EXAMPLE 1

An ethylene/propylene copolymer having the following properties was used as the copolymer to be graft-modified.

Ethylene content: 50 mole %
Number average molecular weight ($\overline{Mn}$): 810
$\overline{Mw}/\overline{Mn}$: 1.40
Intrinsic viscosity [η]: 0.04 dl/g
Z value: 80
σ value: 0.1
Kinematic viscosity (100° C.): 22.8 cst A 2-liter glass reaction vessel equipped with a nitrogen blow-in tube, a water-cooling condenser, a thermometer, two dropping funnels and a stirrer was charged with 800 g of the above-mentioned ethylene/propylene copolymer, and substitution of the inner atmosphere with nitrogen was carried out for 2 hours to expel dissolved oxygen.

Then, the inner temperature of the reaction vessel was elevated to 160° C., and 40 g of maleic anhydride (liquefied by heating at 60° C.) and 8 g of di-t-butyl peroxide charged in the two dropping funnels, respectively, were added dropwise over a period of 4 hours.

After completion of the dropwise addition, reaction was further conducted for 4 hours, and the inner temperature of the reaction vessel was elevated to 180° C. and unreacted maleic anhydride and a decomposition product of di-t-butyl peroxide were removed under a reduced pressure of 0.5 mmHg.

The liquid modified ethylene/propylene copolymer having the following properties was obtained as the product.

Appearance: yellow transparent liquid
Intrinsic viscosity [η]: 0.04 dl/g
Number average molecular weight ($\overline{Mn}$): 815
$\overline{Mw}/\overline{Mn}$: 1.40
Kinematic viscosity (100° C.): 33.8 cst
Grafting ratio: 4.5 parts by weight per 100 parts by weight of ethylene/propylene copolymer

REFERENTIAL EXAMPLE 2

A graft-modified liquid ethylene/propylene copolymer was prepared in the same manner as described in Referential Example 1 except that an ethylene/propylene copolymer having the following properties was used.

Ethylene content: 50 mole %
Number average molecular weight ($\overline{Mn}$): 1450
$\overline{Mw}/\overline{Mn}$: 1.7
Intrinsic viscosity [$\eta$]: 0.05 dl/g
Z value: 100
Kinematic viscosity (100° C.): 110 cst
$\sigma$ value: 0.1

The properties of the obtained liquid modified ethylene/propylene copolymer were as follows.

Appearance: yellow transparent liquid
Intrinsic viscosity [$\eta$]: 0.08 dl/g
Number average molecular weight ($\overline{Mn}$): 1455
$\overline{Mw}/\overline{Mn}$: 1.7
Kinematic viscosity (100° C.): 135 cst
Grafting ratio: 4.4 parts by weight

REFERENTIAL EXAMPLE 3

A liquid modified ethylene/propylene copolymer was prepared in the same manner as described in Referential Example 1 except that 80 g of maleic anhydride and 16 g of di-t-butyl peroxide were added dropwise over a period of 8 hours.

Appearance: yellow transparent liquid
Intrinsic viscosity [$\eta$]: 0.09 dl/g
Number average molecular weight ($\overline{Mn}$): 820
$\overline{Mw}/\overline{Mn}$: 1.5
Kinematic viscosity (100° C.): 170 cst
Grafting ratio: 9.6 parts by weight

REFERENTIAL EXAMPLE 4

An ethylene/propylene copolymer having the following properties was used as the copolymer to be graft-modified.

Ethylene content: 49 mole %
Number average molecular weight ($\overline{Mn}$): 1500
$\overline{Mw}/\overline{Mn}$: 1.65
Intrinsic viscosity [$\eta$]: 0.05 dl/g
Z value: 110
Kinematic viscosity (100° C.): 145 cst
$\sigma$ value: 0.1

A 1-liter glass reaction vessel was charged with 595 g of this ethylene/propylene copolymer, and the temperature was elevated to 140° C.

Then, 105 g of n-butyl methacrylate and 9.0 g of di-t-butyl peroxide were added and heat reaction was conducted for 4 hours.

The deaeration treatment was carried out under a reduced pressure of 10 mmHg while maintaining the temperature at 140° C. to remove volatile components, and then, the reaction product was cooled to obtain a liquid modified ethylene/propylene copolymer.

The properties of the obtained copolymer were as shown below.

Appearance: colorless transparent liquid
Intrinsic viscosity [$\eta$]: 0.06 dl/g
Number average molecular weight ($\overline{Mn}$): 1500
$\overline{Mw}/\overline{Mn}$: 1.63
Kinematic viscosity (100° C.): 200 cst
Grafting ratio: 16 parts by weight (n-butyl methacrylate)

REFERENTIAL EXAMPLE 5

To 126 parts by weight of an isobutylene polymer having a number average molecular weight of 1260 was added 10 parts by weight of maleic anhydride, and reaction was carried out at 180° C. for 5 hours with stirring.

Unreacted maleic anhydride was removed by distillation under reduced pressure to obtain an acid-modified isobutylene copolymer.

The number average molecular weight of this modified copolymer was 1360, and the grafting ratio of maleic anhydride was 7.8 parts by weight per 100 parts by weight of the isobutylene polymer.

EXAMPLES 1 THROUGH 7 AND COMPARATIVE EXAMPLES 1 THROUGH 7

Liquid modified ethylene/propylene copolymers obtained in Referential Examples 1 through 4, starting ethylene/propylene copolymers and load-withstanding additives were mixed at room temperature (25° C.) as shown in Table 1, and the mixtures were heated at 100° C. to obtain homogeneous compositions.

Each of the so-obtained lubricating compositions was allowed to stand still at room temperature for 7 days and the transparency was evaluated with the naked eye according to the following scale:

○: transparent
Δ: semi-transparent
×: opaque or discreted

For comparison, the above-mentioned test was conducted on liquid mixtures of the starting ethylene/propylene copolymers used in Referential Examples 1 through 3 and load-withstanding additives.

The obtained results are shown in Table 1.

TABLE 1

| | Example No. | | | | | | |
|---|---|---|---|---|---|---|---|
| | 1 | 2 | 3 | 4 | 5 | 6 | 7 |
| Modified ethylene/propylene copolymer (C) | | | | | | | |
| Sample | Ref. Ex. 1 | Ref. Ex. 1 | Ref. Ex. 2 | Ref. Ex. 2 | Ref. Ex. 3 | Ref. Ex. 4 | Ref. Ex. 4 |
| Amount (parts by weight) | 50 | 50 | 100 | 100 | 150 | 50 | 100 |
| Unmodified ethylene/propylene copolymer (A) | | | | | | | |
| Sample | *1 | *1 | *2 | *2 | *3 | *4 | *4 |
| Amount (parts by weight) | 100 | 100 | 100 | 100 | 100 | 100 | 100 |
| Load-withstanding additive (B) | | | | | | | |
| Sample | dibutyl | oleyl acid | oleyl- | oleyl | tricresyl | oleic | oleyl acid |

TABLE 1-continued

| | | | | | | | |
|---|---|---|---|---|---|---|---|
| Amount (parts by weight) | phosphate 1 | phosphate 1 | amine 2 | alcohol 2 | phosphate 1 | acid 2 | phosphate 1 |
| Compatibility (transparency) | | | | | | | |

| | Comparative Example No. | | | | | |
|---|---|---|---|---|---|---|
| | 1 | 2 | 3 | 4 | 5 | 6 |
| Modified ethylene/propylene copolymer (C) | | | | | | |
| Sample | | | | | | |
| Amount (parts by weight) | | | | | | |
| Unmodified ethylene/propylene copolymer (A) | | | | | | |
| Sample | *1 | *1 | *2 | *3 | *4 | *4 |
| Amount (parts by weight) | 100 | 100 | 100 | 100 | 100 | 100 |
| Load-withstanding additive (B) | | | | | | |
| Sample | dibutyl phosphate | oleyl acid phosphate | oleyl-amine | tricresyl phosphate | tricresyl phosphate | oleyl acid phosphate |
| Amount (parts by weight) | 1 | 1 | 1 | 1 | 1 | 1 |
| Compatibility (transparency) | x | x | Δ | x | x | x |

Note:
Ref. Ex. = Referential Example
*1: Starting copolymer used in Referential Example 1
*2: Starting copolymer used in Referential Example 2
*3: Starting copolymer used in Referential Example 3
*4: Starting copolymer used in Referential Example 4

Note

All of the amounts in Table 1 are parts by weight.

EXAMPLE 8

In 60 parts by weight of the liquid modified copolymer prepared in Referential Example 2 was incorporated and dissolved 2 parts by weight of molybdenum dithiophosphate (SAKURA-LUBE® #300 supplied by Asahi Denka, Mo content=9.0% by weight, P content=3.2% by weight, S content=10.5% by weight) at room temperature to obtain a brown transparent liquid mixture.

The so-obtained liquid mixture was added to 100 parts by weight of the starting unmodified copolymer used in Referential Example 2, and the mixture was sufficiently stirred to obtain a green transparent stable liquid mixture.

COMPARATIVE EXAMPLE 7

The procedures of Example 8 were repeated in the same manner except that the liquid modified copolymer was not used at all but the unmodified ethylene/propylene copolymer was mixed with molybdenum dithiophosphate. Both the components were not compatible with each other but they were separated from each other.

EXAMPLES 9 THROUGH 11 AND COMPARATIVE EXAMPLES 8 THROUGH 10

A commercially available extreme pressure additive (Package A, TC-7978 supplied by Texaco, S content=2.7% by weight, Ca content=4.1% by weight, Zn content=1.0% by weight, P content=1.0% by weight) was used as the load-withstanding agent.

A liquid mixture was prepared by mixing 13 parts by weight of Package A, a predetermined amount of the liquid modified ethylene/propylene copolymer and 50 parts by weight of an ester oil (diisodecyl adipate) under heating at 100° C. for 30 minutes.

Then, 100 parts by weight of a liquid ethylene/propylene random copolymer having the following properties was added to the so-obtained liquid mixture, and the mixture was stirred at room temperature to obtain a lubricating oil composition.

Ethylene content: 50 mole %
Number average molecular weight ($\overline{Mn}$): 1030
$\overline{Mw}/\overline{Mn}$: 1.5
Intrinsic viscosity [η]: 0.05 dl/g
Kinematic viscosity (100° C.): 40 cst
Z value: 90
σ value: 0.1

With respect to each of the so-obtained compositions, the compatibility was evaluated in the same manner as described in Example 1. The obtained results are shown in Table 2.

As is apparent from the results shown in Table 2, if the amount incorporated of the liquid modified ethylene/propylene copolymer is small, the mixture is opaque and precipitates are formed when the mixture is allowed to stand still, and the mixture is not suitable as a lubricating oil.

Incidentally, in preparing the lubricating oil composition, it was important that the extreme pressure additive, Package A, should be mixed with the liquid modified ethylene/propylene random copolymer under heating in advance and then, the unmodified ethylene/propylene copolymer should be added. If both the copolymers were simultaneously added or heating was not conducted, it was difficult to obtain a transparent composition.

TABLE 2

| | Extreme Pressure | Example 9 | Example 10 | Example 11 | Comparative Example 8 | Comparative Example 9 | Comparative Example 10 |
|---|---|---|---|---|---|---|---|
| B | Additive Package A | 13 parts by weight | 13 parts by weight | 13 parts by weight | 13 parts by weight | 13 parts by weight | 13 parts by weight |

TABLE 2-continued

| Extreme Pressure | Example 9 | Example 10 | Example 11 | Comparative Example 8 | Comparative Example 9 | Comparative Example 10 |
|---|---|---|---|---|---|---|
| Modified Ethylene Propylene Copolymer | 0.8 parts by weight | 2 parts by weight | 5 parts by weight | 0 parts by weight | 0.2 parts by weight | 0.5 parts by weight |
| C Ester Oil | 50 parts by weight | 50 parts by weight | 50 parts by weight | 50 parts by weight | 50 parts by weight | 50 parts by weight |
| A Unmodified Ethylene Propylene Copolymer | 100 parts by weight | 100 parts by weight | 100 parts by weight | 100 parts by weight | 100 parts by weight | 100 parts by weight |
| Compatibility | | | | x | x | Δ |

EXAMPLE 12

A liquid mixture was prepared by mixing 3 parts by weight of a commercially available extreme pressure additive (Package B, Anglamol 98A supplied by Nippon LUBRIZOL INDUSTRIES), 6 parts by weight of the liquid modified ethylene/propylene random copolymer prepared in Referential Example 2 and 13 parts by weight of an ester oil (diisodecyl adipate) under heating at 100° C. for 30 minutes.

The liquid mixture was mixed with 84 parts by weight of the starting unmodified ethylene/propylene copolymer used in Referential Example 2 and 16 parts by weight of a polydecene-1 oligomer (the kinematic viscosity was 12.5 cst as measured at 100° C.), and the mixture was stirred at room temperature (25° C.) to obtain a transparent and stable lubricating oil composition.

COMPARATIVE EXAMPLE 11

A lubricating oil composition was prepared in Example 12 except that the liquid modified ethylene/propylene random copolymer was not incorporated.

This lubricating oil composition was opaque, and when the composition was allowed to stand still, precipitates were formed.

EXAMPLE 13

A lubricating oil composition was prepared in the same manner as described in Example 9 except that a commercially available extreme pressure additive, Package C (LZ3928 supplied by Nippon Brisol, S content=3.3% by weight, Ca content=4.4% by weight, Zn content=0.94% by weight, P content=0.85% by weight, N content=0.25% by weight) was used as the load-withstanding additive.

The obtained lubricating oil composition was transparent and excellent in the compatibility.

COMPARATIVE EXAMPLE 12

A lubricating oil composition was prepared in the same manner as described in Example 13 except that the liquid modified ethylene/propylene copolymer was not used.

The composition was opaque and when the composition was allowed to stand still, precipitates were formed.

EXAMPLE 14

A commercially available organic molybdenum extreme pressure additive (molybdenum dithiophosphate) (SAKURA-LUBE® #300 supplied by Asahi Denka, Mo content=9.0% by weight, P content=3.2% by weight, S=10.5% by weight) was used as the load-withstanding additive.

A liquid mixture was prepared by mixing 5 parts by weight of the above-mentioned extreme pressure additive and 10 parts by weight of the liquid modified ethylene/propylene copolymer prepared in Referential Example 2 under heating at 60° C. for 15 minutes.

The liquid mixture was mixed with 100 parts by weight of an unmodified ethylene/propylene copolymer having properties described below at room temperature with stirring to obtain a bluish green homogeneous transparent lubricating oil composition. Properties of Unmodified Ethylene/Propylene Copolymer Ethylene content: 50 mole %
Number average molecular weight ($\overline{Mn}$): 810
$\overline{Mw}/\overline{Mn}$: 1.40
Intrinsic viscosity [$\eta$]: 0.04 dl/g
Kinematic viscosity (100° C.): 20 cst This lubricating oil composition was excellent in the compatibility.

COMPARATIVE EXAMPLE 13

A lubricating oil composition was prepared in the same manner as described in Example 14 except that the liquid graft-modified ethylene/propylene copolymer was not incorporated.

The composition was opaque, and when the composition was allowed to stand still, precipitates were formed.

EXAMPLE 15

Lubricating characteristics of the lubricating oil prepared in Example 10 were tested.

The obtained results are shown in Table 3.

COMPARATIVE EXAMPLE 14

A commercially available mineral oil type engine oil (for racing) comprising a refined petroleum lubricating oil as the base oil was tested in the same manner as in Example 15.

The obtained results are shown in Table 3.

For comparison, the lubricating oil composition prepared in Comparative Example 8 and a lubricating oil composition prepared in the same manner as described in Example 10 except that the modified isobutene polymer of Referential Example 5 was incorporated instead of the liquid modified ethylene/propylene copolymer of Referential Example 2 were similarly subjected to the test, but the test could not be performed because of the presence of precipitates.

Incidentally, the shear stability was expressed by the reduction ratio of the kinematic viscosity at 100° C., observed when the sample was subjected to ultrasonic wave irradiation (10 kHz, 40° C., 30 minutes).

TABLE 3

| Sample Oil | Example 15 Lubricating oil composition of Example 10 | Comparative Example 14 Commercially available mineral oil type engine oil |
|---|---|---|
| Composition (parts by weight) | | |
| Extreme pressure additive, Package A | 13 | |
| Liquid modified ethylene/proplylene copolymer | 2 | |
| Ester Oil | 50 | |
| Unmodified ethylene/propylene copolymer | 100 | |
| Compatibility | | |
| Kinematic viscosity 100° C. | 19.44 | 21.80 |
| (cst)(JISK-2283) 40° C. | 142.3 | 168.6 |
| Low-temperature viscosity (CPS)(−18° C.) | 7,500 | 8,200 |
| Viscosity index (JISK-2283) | 156 | 154 |
| Load carrying capacity (kgf/cm$^2$) (JISK-2519 Soda four-ball method) | 10.5 | 7.5 |
| Oxidation stability test (JISK-2283) (165.5° C., 48 hours) | | |
| Viscosity ratio | 1.0 | 1.1 |
| Increase of total acid value | 0.9 | 2.5 |
| Racker rating | no adhering substance | no adhering substance |
| Shear stability (ASTM D-2603) | 0 | 15% |

EXAMPLE 16

The procedures of Example 1 were repeated in the same manner except that 100 parts by weight of a poly-α-olefin oligomer (PAO-6, Synfluid CST6 supplied by Chevron Chemical Company, kinematic viscosity=6 cst/100° C., viscosity index=135) was used as the synthetic hydrocarbon oil instead of 100 parts by weight of the starting unmodified ethylene/propylene copolymer used in Example 1. The compatibility was evaluated as "○" (transparent).

EXAMPLE 17

The procedures of Example 1 were repeated in the same manner except that 100 parts by weight of a poly-α-olefin oligomer (PAO-100, SHF-1001 supplied by Mobil Chemical, kinematic viscosity=100 cst/100° C.) was used as the synthetic hydrocarbon oil instead of 100 parts by weight of the starting unmodified ethylene/propylene copolymer used in Example 1. The compatibility was evaluated as "○" (transparent).

We claim:

1. A lubricating oil composition excellent in compatibility, which comprises, as indispensable components, (A) 100 parts by weight of a synthetic hydrocarbon lubricating oil, (B) 0.1 to 20 parts by weight of at least one member selected from the group consisting of oiliness agents and extreme pressure agents and (C) 0.8 to 200 parts by weight of a liquid modified ethylene/α-olefin random copolymer, which is formed by graft-bonding an unsaturated carboxylic acid or a derivative thereof to an ethylene/α-olefin random copolymer, in which (i) the ethylene content in the unmodified ethylene/α-olefin random copolymer is 30 to 75 mole %, (ii) the grafting ratio of the unsaturated carboxylic acid or the derivative thereof is 0.2 to 50 parts by weight per 100 parts by weight of the unmodified ethylene/α-olefin random copolymer and (iii) the intrinsic viscosity as measured in decalin at 135° C. is in the range of from 0.01 to 0.3 dl/g and the molecular weight distribution ($\overline{Mw}/\overline{Mn}$) determined by gel permeation chromatography is not larger than 4.

2. A lubricating oil composition as set forth in claim 1, wherein said at least one member selected from the group consisting of oiliness agents and extreme pressure agents (B) and the liquid modified ethylene/α-olefin random copolymer (C) are incorporated at a (B)/(C) weight ratio of from 0.05 to 200.

3. A lubricating oil composition as set forth in claim 1, wherein the synthetic hydrocarbon lubricating oil (A) is a poly-α-olefin oil or an ethylene/α-olefin random copolymer oil.

4. A lubricating oil composition as set forth in claim 3, wherein the liquid modified ethylene/α-olefin random copolymer (C) is a graft modification product of said ethylene/α-olefin random copolymer oil.

5. A lubricating oil composition as set forth in claim 1, wherein said oiliness agent comprises a higher fatty acid, a higher alcohol or a higher amine.

6. A lubricating oil composition as set forth in claim 5, wherein said oiliness agent comprises oleic acid, stearic acid, oleyl alcohol, stearyl alcohol, palmityl alcohol, oleylamine, stearylamine or palmitylamine.

7. A lubricating oil composition as set forth in claim 1, wherein said extreme pressure agent comprises a sulfur-containing compound, a phosphorous-containing compound, a halogen-containing compound or an organometal compound.

8. A lubricating oil composition as set forth in claim 7, wherein said extreme pressure agent comprises a sulfur-containing compound and a phosphorous-containing compound.

9. A lubricating oil composition as set forth in claim 7, wherein said extreme pressure agent comprises dibutyldithiocarbamic acid sulfide, dibenzyl sulfide, dibutyl phosphate, diphenyl phosphate, oleyl chloride, chlorinated paraffin, zinc dithiophosphate, molybdenum dithiophosphate or lead naphthenate.

10. A lubricating oil composition as set forth in claim 1, wherein said α-olefin of said ethylene/α-olefin random copolymer has 3–20 carbon atoms.

11. A lubricating oil composition as set forth in claim 1, wherein said ethylene content in said unmodified ethylene/α-olefin random copolymer is 40 to 70 mole %.

12. A lubricating oil composition as set forth in claim 1, wherein said grafting ratio of the unsaturated carboxylic acid or the derivative thereof is 0.5 to 40 parts by weight per 100 parts by weight of the unmodified ethylene/α-olefin random copolymer.

13. A lubricating oil composition as set forth in claim 1, wherein said carboxylic acid has 3 to 20 carbon atoms.

14. A lubricating oil composition as set forth in claim 13, wherein said carboxylic acid has 3 to 10 carbon atoms.

15. A lubricating oil composition as set forth in claim 1, wherein said unsaturated carboxylic acid or derivative thereof comprises acrylic acid, methacrylic acid, maleic acid, fumaric acid, itaconic acid, citraconic acid, tetrahydrophthalic acid, bicyclo(2,2,1)-hept-2-ene-5,6-dicarboxylic acid, maleic anhydride, itaconic anhydride, citraconic anhydride, tetrahydrophthalic anhydride, bicyclo(2,2,1)-hept-2-ene-5,6-dicarboxylic acid anhydride, methyl acrylate, methyl methacrylate, dimethyl maleate, monomethyl maleate, diethyl fumarate, dimethyl itaconate, diethyl citraconate, dimethyl tetrahydrophthalate or dimethyl bicyclo(2,2,1)-hept-2-ene-5,6-dicarboxylate.

16. A lubricating oil as set forth in claim 1, wherein said unmodified copolymer has an intrinsic viscosity as measured in decalin at 135° C. in the range of 0.03 to 0.25 dl/g.

17. A lubricating oil as set forth in claim 1, wherein said unmodified copolymer has a number average molecular weight of 300 to 12,000.

18. A lubricating oil as set forth in claim 17, wherein said number average molecular weight is 500 to 8,000.

19. A lubricating oil as set forth in claim 18, wherein said number average molecular weight is 500 to 4,000.

20. A lubricating oil as set forth in claim 19, wherein said unmodified polymer has a molecular weight distribution ($\overline{Mw}/\overline{Mn}$) determined by gel permeation chromatography of 1.2 to 3.

* * * * *

UNITED STATES PATENT AND TRADEMARK OFFICE

CERTIFICATE OF CORRECTION

PATENT NO. : 4,877,557

DATED : October 31, 1989

INVENTOR(S) : RYOUSUKE KANESHIGE ET AL.

It is certified that error appears in the above-identified patent and that said Letters Patent is hereby corrected as shown below:

Columns 11 and 12, in Table 1-continued, in the row labelled "Compatability (transparency)", in each of the columns corresponding to Examples 1-7, insert the mark -- ○ --.

Columns 13 and 14, in Table 2-continued, in the row labelled "Compatability", in each of the columns corresponding to Examples 9-11, insert the mark -- ○ --.

Signed and Sealed this

Twenty-sixth Day of March, 1991

*Attest:*

HARRY F. MANBECK, JR.

*Attesting Officer*

*Commissioner of Patents and Trademarks*